United States Patent [19]

Boyle et al.

[11] 4,313,556

[45] Feb. 2, 1982

[54] CARTON HAVING FOLDABLE BOTTOM AND CARTON BLANK

[75] Inventors: Daniel J. Boyle, Hartland; Harold R. Jaeschke, Milwaukee, both of Wis.

[73] Assignee: Champion International Corporation, Stamford, Conn.

[21] Appl. No.: 196,789

[22] Filed: Oct. 14, 1980

[51] Int. Cl.[3] ..... B65D 5/08

[52] U.S. Cl. ..... 229/38; 229/41 B

[58] Field of Search ..... 229/8, 41 B, 38

[56] References Cited

U.S. PATENT DOCUMENTS

| | | | |
|---|---|---|---|
| 2,050,894 | 8/1936 | Paige | 229/8 X |
| 2,067,998 | 1/1937 | Williamson | 229/8 X |
| 2,841,319 | 7/1958 | White et al. | 229/8 X |
| 3,369,727 | 2/1968 | Wright | 229/8 X |
| 3,610,514 | 10/1971 | Samsing | 229/8 X |
| 3,622,065 | 11/1971 | Buttenfill | 229/38 |
| 4,054,203 | 10/1977 | Fanquhar | 229/38 X |
| 4,129,248 | 12/1978 | Casutt | 229/41 B |

*Primary Examiner*—Herbert F. Ross

*Attorney, Agent, or Firm*—Evelyn M. Sommer

[57] ABSTRACT

A one-piece carton blank produces a carton which may be glued, shipped and stored in its flat state and which may be erected by pressure on its side panels. The carton includes rectangular bottom panels which are held sandwiched between side panels when the glued carton is in its flat state and which are unfolded 180° upon erection of the carton; bottom side support panels which are unfolded upon erection of the carton to become perpendicular to the carton bottom; fold lines on two opposite side panels to permit the carton to be folded (in its flat state) and unfolded (in its erected state); and, if desired, four corner panels which, for example, may be elliptical or diamond in shape.

4 Claims, 8 Drawing Figures

CARTON HAVING FOLDABLE BOTTOM AND CARTON BLANK

BACKGROUND OF THE INVENTION

The present invention relates to paperboard cartons and more particularly to a one-piece paperboard carton blank which is glued and erected from that blank.

Many types of paperboard cartons, such as cardboard cartons, have been developed for the attractive packaging of small articles, such as drug items, cosmetics, etc.

It may be desirable that such cartons be able to be shipped and stored in a flat (unerected) state to lower the costs of shipment and storage. In addition, when the carton is ready to be filled, it may be desirable that it be erected by a simple hand or machine action, for example, by pressure on its opposite sides.

In addition to cartons having four flat rectangular sides, it is known that cartons may be produced with corners having various shapes, such as ellipses, in order that the carton may be more attractive or better adapted to the item it contains.

OBJECTIVES AND FEATURES OF THE INVENTION

It is an objective of the present invention to provide a paperboard carton and a one-piece paperboard carton blank which may be erected into the carton, in which the carton's corners may be elliptical panels, diamond-shaped panels, panels of other shapes, or squared.

It is a further objective of the present invention to provide a paperboard carton and a one-piece paperboard carton blank which may be erected into the carton, in which the carton bottom has a center fold permitting the carton, after assembly but before the contents are inserted, to be shipped and stored flat and permitting it to be easily and quickly erected, when the contents are to be inserted, by unfolding the bottom panels 180° automatically upon erection of the carton.

It is a still further objective of the present invention to provide a paperboard carton and a one-piece paperboard carton blank which may be erected into the carton, in which bottom panel members are pivoted when the glued carton is unflattened and erected to form support members at 90° to the bottom, thereby adding strength and rigidity to the carton.

It is a feature of the present invention to provide a one-piece paperboard carton blank adapted to be glued and then erected into a carton by pressure on its sides. The carton blank and the carton includes a plurality of at least four central side panels which form the sides of the carton. The side panels in the carton blank are arranged in tandem along an imaginary central axis. Preferably the side panels are connected by fold lines to corner panels, for example, of elliptical or diamond shape. A plurality of top flap members are connected by fold lines to certain of the central panels. The top flap members form the top of the erected carton.

The carton blank and carton further include a first bottom panel and a second bottom panel. Each of the bottom panels are connected by fold lines to those side panels which form opposite sides of the erected carton. A panel is connected by a fold line to the second bottom panel and it has glue means to adhere it to the first bottom panel. In the glued carton, before erection, the bottom panels lie against each other and they are sandwiched between the side panels to which they are connected.

It is a further feature of the present invention to provide such a carton blank, and carton, which also includes four bottom support panels, each bottom support panel being connected by a fold line to a side of a bottom panel. It further includes four triangular shaped panels, each triangular panel being connected by a fold line to the bottom of a central side panel, connected by a fold line to a side support panel, and having a glue area to adhere it to the side panel of the glued carton to which it is connected.

BRIEF DESCRIPTION OF THE DRAWINGS

Other objectives and features of the present invention will be apparent from the detailed description of the present invention set forth below, taken in conjunction with the accompanying drawings, which relate to a preferred embodiment of the invention.

In the drawings.

DETAILED DESCRIPTION OF THE INVENTION

Figure 1:
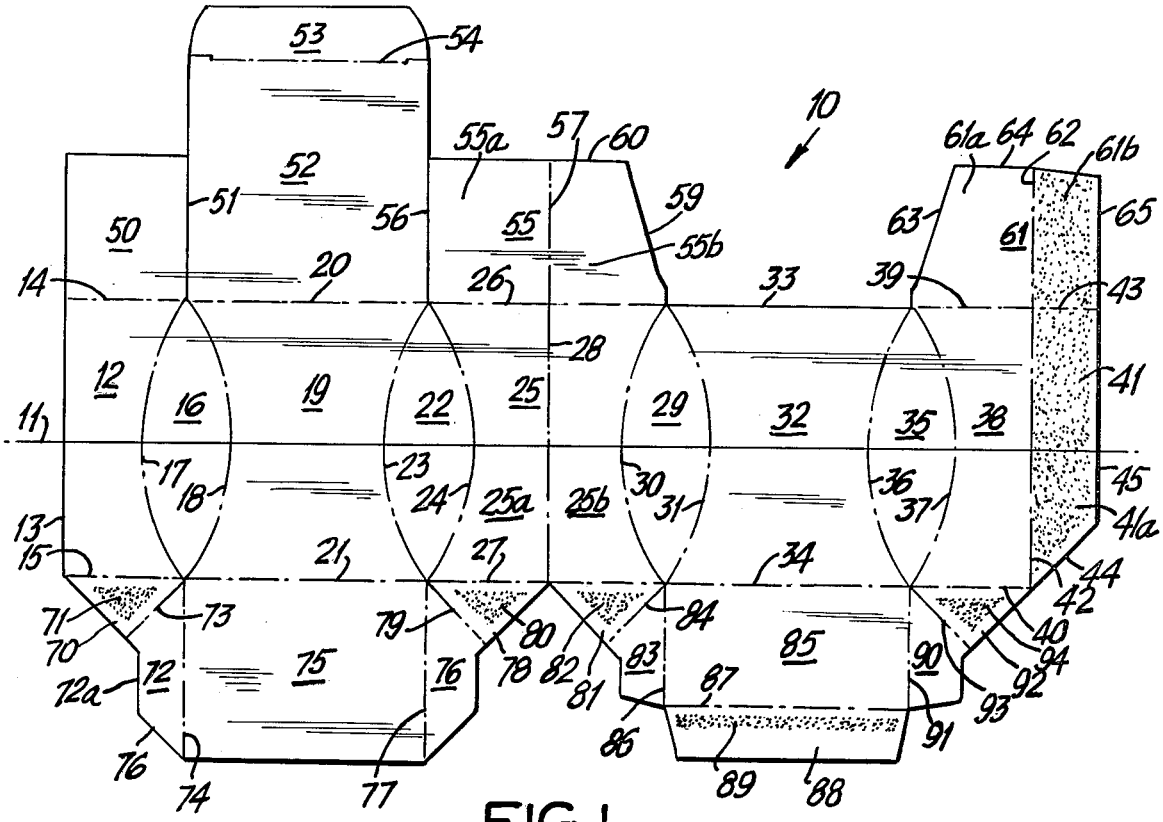
FIG. 1 is a top plan view of the one-piece paperboard carton blank of the present invention.
Figure 2:
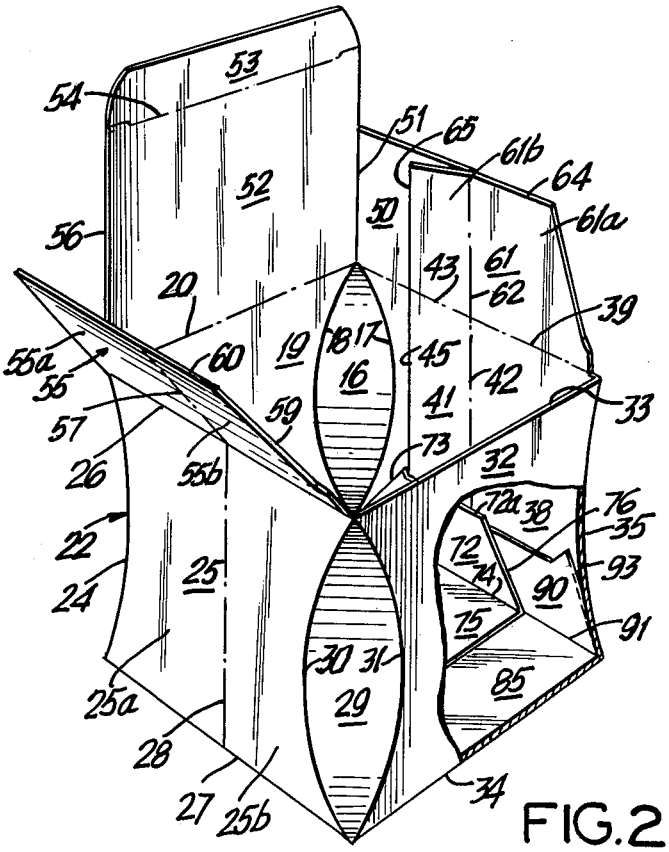
FIG. 2 is a perspective view, taken from the top, of the carton of the present invention, with its top flaps raised and partially broken away.

As shown in FIG. 1, the carton of the present invention is constructed from a one-piece paperboard blank. For example, the paperboard may be coated cardboard. The blank may be die-cut using conventional machines and technology. In the drawings, fold lines (crease lines) are indicated by dot-dash lines and cut lines by solid lines.

The paperboard blank 10 includes a series of panel members arranged in tandem along an imaginary central axis 11. The panels illustrated in FIG. 1 include four corner panels of elliptical shape. However, as shown in connection with FIG. 6, alternatively panels of other shapes may be used in place of the elliptical panels of FIG. 1 or the corner panels may be eliminated and the corners may have perpendicular, i.e., squared, walls.

Panel 12, the first half of the first side panel of the assembled carton, is the first of the tandem series of panels and has a straight free edge 13 and opposite respective top and bottom fold lines 14 and 15 which are perpendicular to its side edge 13. The first elliptical corner panel 16 is formed by an elliptically curved fold line 17 and elliptically curved fold line 18 which joins the elliptical panel 16 to the side panel 19.

The second side panel 19 has respective top and bottom fold lines 20 and 21 parallel to each other and in line with the fold lines 14 and 15, respectively. The second elliptical corner panel 22 is joined to the side panel 19 by the elliptical fold line 23 and opposite thereto the elliptical fold line 24 (of the elliptical panel 22) joins the elliptical panel 22 to the side panel 25. The third side panel 25 has respective top and bottom straight fold lines 26,27, parallel to each other, which are extensions of the respective fold lines 20,21. A center fold line 28, within the side panel 25, divides the panel 25 into two symmetrical halves 25*a*, 25*b*.

The third elliptical corner panel 29 is formed by the elliptical fold line 30, which joins the elliptical corner panel 29 to the side panel 25, and its opposite elliptical curve fold line 31, which joins the elliptical panel 29 to the fourth side panel 32. Similarly, the elliptical corner panel 35 is formed by an elliptical curved fold line 36, joining it to the panel 32, and an opposite elliptical curved fold line 37 joining it to the side panel 38. The side panel 38 is the second half of the first side panel of the carton. The panel 32 has opposite parallel respective top and bottom fold lines 33,34 which are aligned with the previously mentioned top and bottom fold lines 33,34. The side panel 38 is joined to the panel 41 by a straight fold line 42. Panel 41 has a straight fold line 43 which is an extension of the fold line 39 and a free edge 44 which is at an angle, preferably an angle of 45°, relative to the fold line 40. The panel 41 also has a straight free edge 45 which is parallel to its fold line 42. The face of panel 41 has an adhesive glue 41*a* permitting it to be glued to another panel.

A series of flap members are used to close the top of the carton erected from the blank 10 and those flaps are connected by fold lines along the top ends of certain of the central panel members. The first top flap 50, which is a rectangular flap member, is connected to the panel member 12 by the fold line 14. A cut line 51 is used between the first flap 50 and the second top flap 52. The second top flap 52, which is connected to the panel member 19 by the fold line 20, has a tuck flap 53 connected to it by the fold line 54. The third top flap 55 is formed by the cut line 56 and its opposite angled edge cut line 59. The third flap 55 has an internal fold line 57 dividing it into flap portions 55*a*, 55*b*, and a free edge 60 which is parallel to its fold line 26.

The fourth top flap 61 is formed by the fold line 39 which attaches it to the panels 38 and 41. The fourth top flap 61 has a free edge 63 which is angled with respect to the fold line 39, a straight free edge 64 which is parallel to the fold line 39, and an outer free edge 65. An internal fold line 62 divides top flap 61 into flap portions 61*a*, 61*b*.

A series of panels along the bottom edges of the center panels are used to form the bottom of the carton. These panels include first triangular panel 70 which is an equilateral triangle having a center glue area 71. It is attached to the panel 12 by the fold line 15 and attached to the panel 72 by the partial fold and score line 73, i.e., the line 73 is a cut line (close to elliptical panel 11) and then becomes a fold line. The panel 72 has a fold line 74 connecting it to the first bottom panel 75 and a free outer edge 72*a* parallel thereto, and an angled bottom edge 76. The first bottom panel 75 is connected to the panel 19 by the fold line 21 and is connected to the panel 76 by the fold line 77. Panel 76 is connected to the triangular panel 78 by the partial fold and partial score line 79. The panel 78, which is shaped like an equilateral triangle, has a central triangularly shaped glue area 80.

A still further triangular panel 81, having a triangular glue area 82, is connected to the bottom side panel 83 (bottom support panel) by the partial cut and fold line 84. Panel 83 is connected to the second bottom panel 85, which is a rectangular panel, by the fold line 86. The second bottom panel 86 has a fold line 87 which connects it to the elongated panel 88 (connection panel), the elongated panel having a stripe of glue 89. The second bottom panel 85 is connected to the bottom side panel 90 (bottom support panel) by a fold line 91. The panel 90 is connected to the triangular panel 92 by the cut and fold line 93. The triangular panel 92 is of the same size and shape as the other triangular panels 81, 78 and 70 and also has a central glue area 94.

The carton is formed in its assembled state from the one-piece carton blank shown in FIG. 1 by adhering the glue areas to certain areas of the carton blank. The carton is glued (assembled) and shipped to the user in a flattened condition. The carton may subsequently be easily erected by the user by simply applying pressure on two opposite points. After the carton has been erected by the user, it may be filled with contents and its top flaps closed, to present a fully erected and closed carton.

The assembly of the carton comprises adhering the glue 41*a* which covers the top face of the panel 41 (the face seen in FIG. 1) to the bottom face (the face unseen in FIG. 1) of the panel 12 with the fold line 42 aligned (next to) the free edge 13 of the panel 12. The glue area 89 on the elongated panel 88 is adhered to the top face of a portion of the panel 75. A flap is formed by adhering the top face of flap portion 61*b* to the bottom face of the first top flap 50. The fold line 87 of panel 85 is positioned so that it becomes the center fold of the bottom of the carton, the bottom of the carton being formed by the panels 75 and 85. The elongated panel 88 (connection panel) is adhered to the panel 75 so that the fold line 87 is aligned with an imaginary line on panel 75, which would be an extension of the fold line 87.

Each of the triangular glue areas 71, 80, 82 and 94 are adhered to their adjacent center panel. Specifically, the glue area 71 is adhered to the bottom face of the panel 12, after the triangular panel 70 has been folded against the panel 12 along the fold line 15. Similarly, the glue area 80 is adhered to the bottom face of the panel 25*a*, the glue area 82 is adhered to the bottom face of the panel 25*b* and the glue area 94 is adhered to the bottom face of the panel 38.

The assembled and unerected carton is now in its flat condition, with the bottom panels 85 and 75 held sandwiched between the center panels and with the top flaps extended. The fold lines 42 and 28 are folded to obtain this flat state of the carton.

Figure 3:
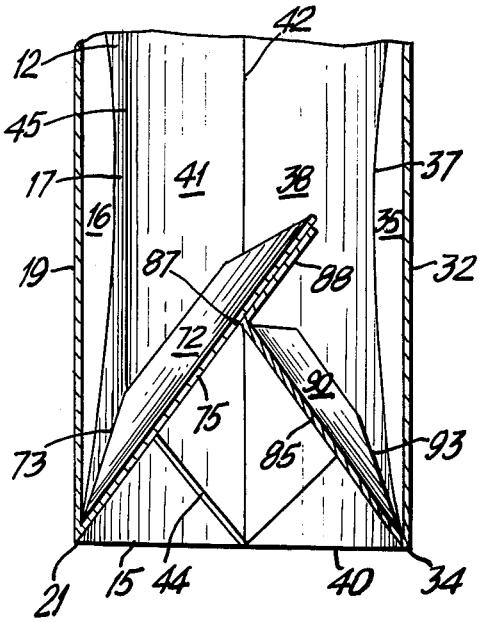
FIG. 3 is a cross-sectional view of the bottom flaps of the carton of the present invention, with the carton partially erected.
Figure 4:
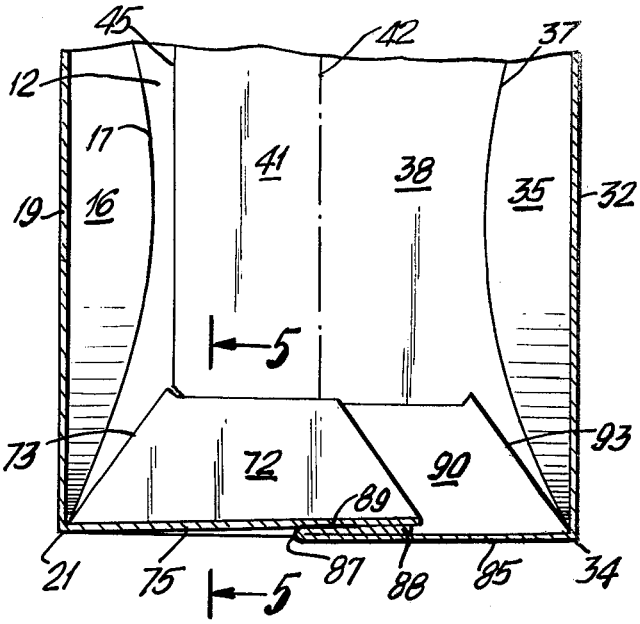
FIG. 4 is a bottom view similar to FIG. 3 but with the carton fully erected.
Figure 5:
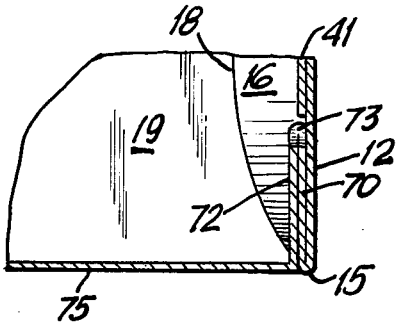
FIG. 5 is a cross-sectional view of the bottom portion of the erected carton taken along lines 5—5 of FIG. 4.

To erect the carton, the user may apply pressure on both ends of the carton, i.e., by applying pressure on the fold lines 42 and 28. Such pressure will, as shown in FIGS. 3 and 4, cause the bottom panels 75 and 85 to flex downwardly about 180° from within the carton to an intermediate position (as shown in FIG. 3) and then to a fully open position (as shown in FIG. 4) in which the bottom formed by the panels 75 and 85 is flat. The same unfolding action which causes the flattening of the bottom also causes the bottom side panels 72, 76, 83 and 90 (bottom support panels) to move from their flat position (when the carton is in its flat state) to a preferably perpendicular position relative to the bottom when the carton has been fully erected.

When the carton is erected, the bottom side panels 72, 76, 83 and 90 are perpendicular to the bottom and strengthen the carton and make it more rigid. The user then places the contents within the carton and closes the carton by pushing the flap 55 and the flap formed by adhering the flap portions 61*b* and 50 inwardly; bending downwardly the top flap 52; and placing the tuck 53 within the erected carton.

Figure 6A:
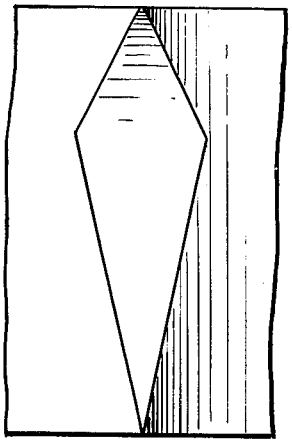
FIGS. 6A–6C are side plan views of alternative corner panels.
Figure 6B:
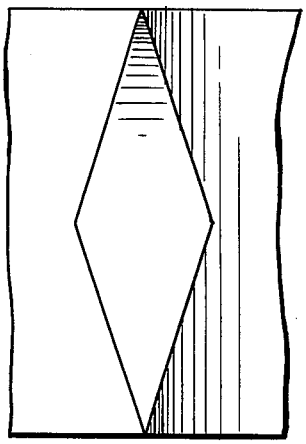
Figure 6C:
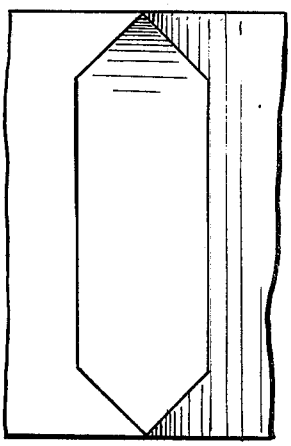

Other types of corner panels may be used instead of the elliptical corner panels shown in FIG. 1. For example, as shown in FIG. 6A, the corner panels may be diamond-shaped with the internal angle at the top of the diamond larger than the internal angle at the bottom. As shown in FIG. 6B the corner panels may be diamonds having equal opposed angles, or, as shown in FIG. 6C, they may be panels having straight sides and inwardly angled top and bottom ends. Other shaped panels may alternatively be used or the corners may be without panels, using a straight fold line to form rectangular (squared) corners with the side panels.

What is claimed is:

1. A one-piece paperboard carton blank adapted to be glued and then erected into a carton; said blank comprising:

four central side panels which form the sides of the carton, said side panels being arranged in tandem along an imaginary central axis and being connected by fold lines;

a plurality of top flap members connected by fold lines to certain of the central side panels, said top flap members being adapted to form the top of the erected carton;

a first rectangular bottom panel and a second rectangular bottom panel, each of said bottom panels being connected by fold lines to the two side panels which form opposite sides of the erected carton; and a connection panel connected by a fold line to the second bottom panel and having a glue means to adhere it to the first bottom panel;

wherein the other two central side panels which are not connected to said bottom panels have fold lines perpendicular to said axis to enable the glued and unerected carton to lie flat;

the carton blank further comprising:

four bottom support panels, each bottom support panel being connected by a fold line to a side of a bottom panel; and four equilateral triangular shaped panels, each triangular panel being hingedly connected by a fold line to the bottom of one of said other two central side panels and, hingedly connected by a fold line to one of said bottom support panels, and having glue means to adhere said each triangular panel to the side panel to which it is connected, said carton blank further comprising corner panels connected by fold lines to said central side panels, said corner panels being aligned between said side panels and aligned along said imaginary axis.

2. A carton blank as in claim 1 wherein said corner panels are elliptical in shape.

3. A carton blank as in claim 1 wherein said corner panels are diamond in shape.

4. A carton blank as in claim 1 wherein said corner panels have straight sides and inwardly angled top and bottom sides.

* * * * *